US005529557A

United States Patent [19]

Barton

[11] Patent Number: 5,529,557

[45] Date of Patent: Jun. 25, 1996

[54] DUAL-SEAT PHYSICAL EXERCISER

[76] Inventor: Randy L. Barton, 528 State St., Sterling, Colo. 80751

[21] Appl. No.: 349,673

[22] Filed: Dec. 5, 1994

[51] Int. Cl.[6] ..... A63B 21/068

[52] U.S. Cl. ..... 482/95; 482/112; 482/73

[58] Field of Search ..... 472/120, 121, 472/124, 125, 108, 110, 111, 122, 123; 482/95, 96, 112, 113, 130, 72, 73

[56] References Cited

U.S. PATENT DOCUMENTS

| | | | |
|---|---|---|---|
| 226,482 | 4/1880 | Bowen | 472/122 |
| D. 279,917 | 7/1985 | Hill . | |
| D. 284,780 | 7/1986 | Brentham . | |
| 1,264,172 | 4/1918 | Fritz | 472/121 |
| 4,047,715 | 9/1977 | Gjessing . | |
| 4,220,329 | 9/1980 | Agyagos . | |
| 4,257,593 | 4/1981 | Keiser . | |
| 4,570,928 | 2/1986 | Smith | 472/120 |
| 4,627,617 | 12/1986 | Gilmore et al. . | |
| 4,627,619 | 12/1986 | Rockwell et al. . | |
| 4,828,253 | 5/1989 | Schicketanz . | |
| 4,944,507 | 7/1990 | Efstratis | 472/125 |
| 5,007,632 | 4/1991 | Wilkinson . | |
| 5,104,363 | 4/1992 | Shi . | |
| 5,178,599 | 1/1993 | Scott | 482/113 |

*Primary Examiner*—Lynne A. Reichard
*Attorney, Agent, or Firm*—H. Dennis Kelly; Timmons & Kelly; Jeffrey T. Hubbard

[57] ABSTRACT

A frame has a base and four vertical members supporting a pair of longitudinal supports spaced evenly apart to define a slot. A pair of seats are arranged in opposition at the ends of the frame and a exercise arm is located between the seats. The exercise arm reciprocates between the seats, and has handles for gripping. A dashpot provides resistance to movement of the exercise arm. The device can be adapted for use by one or two users.

18 Claims, 2 Drawing Sheets

DUAL-SEAT PHYSICAL EXERCISER

BACKGROUND OF INVENTION

1. Field of the Invention

The present invention relates to exercising machines. More particularly, the present invention is directed to an abdominal exercise apparatus that utilizes an adjustable resistance element and that is adapted to accommodate one or two users in a tandem arrangement.

2. Description of the Background Art

The past two decades have seen a renewed interest in physical fitness, body-building, and other strength and endurance enhancing activities. Despite the health benefits of such activities, a number of disadvantages exist that prevent their uniform acceptance and application by the general public.

Individuals traditionally sought physical fitness and muscle enhancing exercise through the use of freeweights. Unfortunately, freeweights are generally considered to be bulky, cumbersome, and old-fashioned by the typical exercise enthusiast.

Exercise machines incorporating mechanical, pneumatic, and hydraulic resistance elements attempt to address the disadvantages associated with the use of freeweights. Some of the machines include the ability to isolate the development of the abdominal muscle groups. Such devices have included the use of weights incorporated in a variety of hinge and pulley systems, as well as the use of pneumatic or hydraulic resistance elements.

Both freeweight and conventional machine methods of weight training are solitary, self-paced activities, and demand a large degree of self discipline and persistence to maintain an aggressive physical fitness program. Individuals not possessed of such self discipline often fail to reach their goals in their program's initial stages and often abandon the program altogether.

Traditional mechanical abdominal exercise apparatus are also limited in that they provide resistance to the abdominal muscles only in a single forward direction. Thus, the abdominal muscles are not completely developed via conventional abdominal exercise apparatus.

Yet other disadvantages associated with weight and fitness training include muscle strain related injuries occasioned during an aggressive developmental program. Many exercise apparatus, and traditional abdominal exercise machines in particular, have often been faulted for placing an undue amount of stress on the lower back, thereby giving rise to discomfort and lower back pain. As might be expected, such discomfort and pain also serves as a disincentive to continued training.

A need remained for a device that promotes sustained use of the device by allowing operation by two users in a partnership. A structure that exercises abdominal muscles without creating lower back strain and fatigue was also desired. As always, a less expensive structure that is simple to make and use was also desired.

SUMMARY OF THE INVENTION

The principal object of the invention is to exercise the abdominal muscles. This object is achieved by providing an apparatus operable via one or two individuals in a tandem arrangement, where resistance for the abdominal muscles is attained via a hydraulic resistance element, such as a dashpot. The exercise apparatus of the present invention minimizes lower back stress and exercises the abdominal muscles by promoting movement of the torso in at least two directions of travel.

The present invention includes a frame having a base, several vertical supports, a pair of longitudinal supports running between the vertical supports, and two seating assemblies. An exercise element is coupled to the longitudinal supports by a pivot. The bottom end of the exercise element connects by a pivot to a dashpot that is in turn connected to the frame with a pivot. The top end of the exercise element connects by a pivot to a two-ended handle that can be gripped by one or two individuals.

In operation, an individual grasps one end of the handle and reciprocates the handle between a first position and a second position. This reciprocation of the pivot arm is opposed by the resistance element and a biasing element, in the case of one user, or by the resistance element and a second user when used in a tandem arrangement.

Another object of the invention is to encourage the user to continue using the invention regularly over an extended period of time. This object is achieved by the two user configuration. Having an exercise partner provides motivation and discipline often absent in a solitary workout environment.

Yet another object of the invention is to provide a thorough abdominal workout without the creation of undesired and excess stress to the lower back. This object is achieved by the method of exercising the abdominal muscles by pushing the upper body backward against the back of the seat, instead of pulling the upper body up from a prone position, as when doing situps.

Still another object of the invention is to offer separate adjustment for resistance in each direction of travel of the exercise element. This object is achieved by a pair of bypass lines, one line for each direction of travel, installed on the dashpot. Each line has an adjustable bypass valve connected in series with a check valve, so that flow through the line is allowed in only one direction. When the dashpot is stroked, some of the fluid that would normally be forced through the dashpot's inner valving will flow through one of the bypass lines, reducing the overall resistance to motion. Adjustment of each bypass valve will reduce resistance to motion in one of the two directions of travel of the device.

Other advantages and benefits of the present invention may be seen by reference to the following illustrations and accompanying description.

DETAILED DESCRIPTION OF THE PREFERRED EMBODIMENTS

Figure 1:
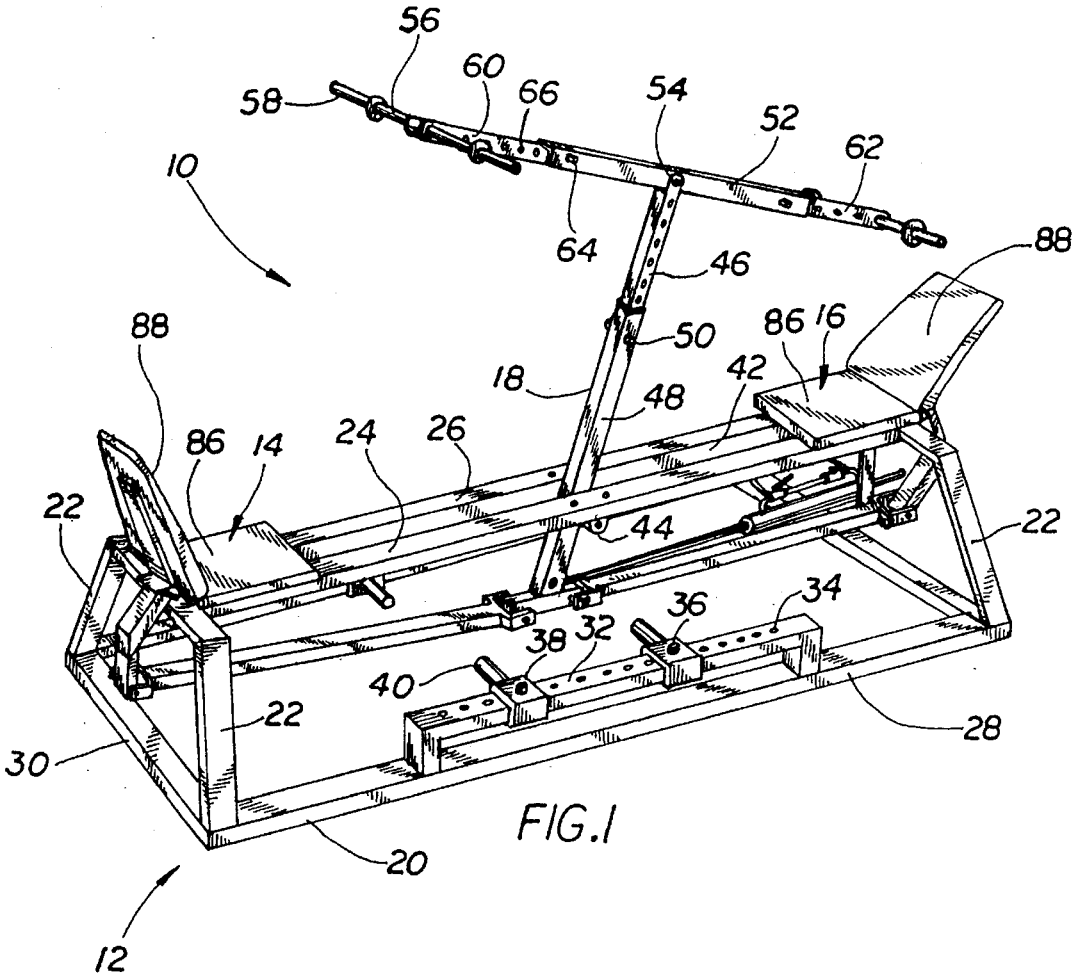
FIG. 1 is a perspective view of an exercise device according to the invention.

The exercise apparatus 10 of the invention includes a frame 12, two seating assemblies 14 and 16, and an exercise element 18 located midway between the seat assemblies 14 and 16. Frame 12 includes a base 20, several vertical supports 22, and longitudinal supports 24 and 26 that are supported by the vertical supports 22, as shown. The base 20 in turn includes long members 28 and cross pieces 30, welded or bolted together in a conventional fashion. The frame 12 may be made from tubular steel or other material having the necessary strength to bear repeated loading.

A support subframe 32 made of square metal tubing is attached to each long member 28. A number of holes 34, evenly spaced along the top of each subframe 32, are adapted to receive and hold a peg 36. A pair of cleats 38, one for each user, is located on each of the subframes 32 and slide along them. Each cleat 38 has a hole (not shown), also adapted to receive the peg 36, and a foot rest 40. The foot rest 40 can be set to different positions by sliding the cleat 38 to the desired position, matching the hole in the cleat with the nearest hole 34 in the subframe 32 and inserting the peg 36 through the holes.

The longitudinal supports 24 and 26 are closely spaced parallel to each other, defining a slot 42 between them. The exercise element 18 is coupled to the longitudinal supports 24 and 26 by a pivot 44. The pivot 44 may be a pillow bearing or the like held in place with a conventional fastener, such as a cotter pin (not shown). The exercise element 18 may be manufactured from tubular steel or other rigid material adapted to withstand repeated loading.

The exercise element 18 includes upper 46 and lower 48 elements. The upper element 46 slides into the lower element 48 in a telescoping fashion, and a pin 50 holds them together. The pin 50 and the elements 46 and 48 allow the length of the exercise element 18 to be adjusted to the users' taste.

The upper element 46 is coupled to a handle element 52 by a pivot 54 that may again comprise a pillow bearing or similar structure. The handle element 52 is coupled at both ends to operator handles 56, manufactured from tubular steel and fitted with a roller-type or cushioned grip 58 in a conventional fashion. The length of the handle element 52 is also adjustable via telescoping subparts 60 and 62, the length being selected by inserting a pin 64 in a selected hole 66.

To operate the device, each user sits in one of the seat assemblies 14 and 16 and grasps the appropriate grip 58, while anchoring their feet against the foot rests 40. Each user takes turns pulling on the operator handle 56 causing the upper element 46 to move toward them. A resistance element 68 opposes movement of the exercise element 18. The action of moving the exercise element 18 against this resistance exercises the abdominal muscles.

Figure 2:
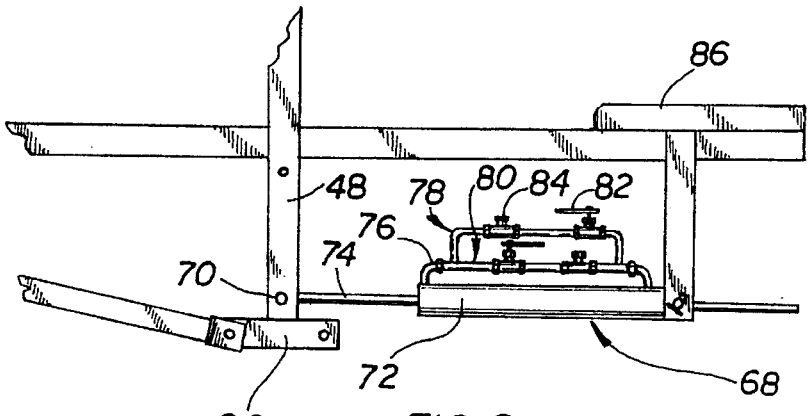
FIG. 2 is a side detail thereof, showing the hydraulic resistance element.

FIG. 2 shows the lower element 48 coupled to a resistance element 68 through a pivot 70 similar to the other pivots 44 and 54. The resistance element 68 is a dashpot, defined as a hydraulic device for damping movement via hydraulic resistance. The dashpot 68 has a cylinder 72 filled with hydraulic fluid and a piston (not shown) that seals loosely against the inside surface of the cylinder so that a force applied against the piston will cause hydraulic fluid to flow across the loose seal from one side of the piston to the other. The piston is attached to a shaft 74 that is coupled at one end to the lower element 48. The shaft 74 should extend out both ends of the cylinder 72: this creates equal displacement volumes on both sides of the piston. This symmetry allows the piston to move completely from one end of the cylinder 72 to the other, allowing for a shorter cylinder. A shorter cylinder is preferred to avoid obstruction with the frame 12 during operation of the device.

The cylinder 72 has external couplings 76 that connect to two bypass assemblies 78 and 80 that provide the means for bypassing the hydraulic fluid around the piston (not shown). Each assembly includes an adjustable valve 82 and a check valve 84, both sized to allow several times the flow of hydraulic fluid across the piston seal when the shaft 74 is stroked. The bypassing of fluid through the assemblies 78 and 80 provides the means for adjusting the resistance to movement of the exercise element 18. The first assembly 78 operates when the exercise element 18 is moved in one direction, while the second assembly 80 operates when the exercise element 18 is moved in the other direction, to allow each user to tailor the resistance in their direction individually.

Figure 3:
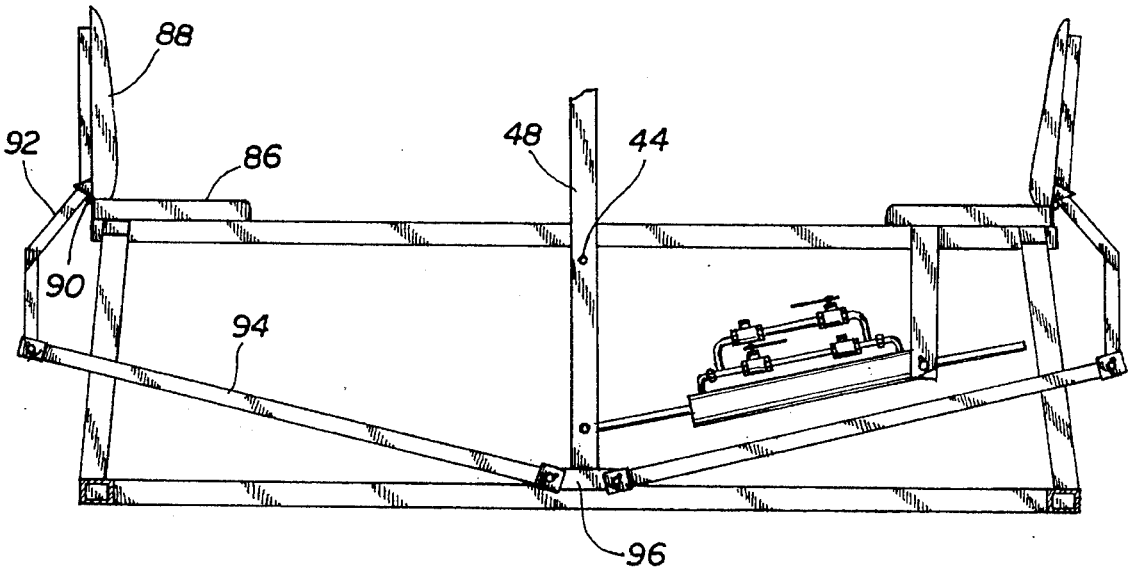
FIG. 3 is a side detail thereof, showing a seat assembly and linkage to the exercise element.

Turning now to FIG. 3, one of the seating assemblies 14 is shown; the two assemblies 14 and 16 are identical. Each assembly includes a bottom piece 86 and a backrest 88, both provided with a cushioned covering for comfort. The bottom piece 86 is securely fixed to the longitudinal supports 24 and 26. The backrest 88 is coupled to the bottom piece 86 by means of a pivot 90, which may be a hinge, a pivot similar to the other pivots, or an equivalent structure. An upper linkage arm 92, affixed to the backrest 88, pivotably connects to a lower linkage arm 94 that in turn connects to a tee piece 96 at the end of the lower element 48. This combination allows the backrest 88 to rock back and forth in conjunction with the exercise element 18. This provides improved back support during operation and reduces lower back stress.

In addition, the rocking backrest 88 creates other means for exercising the abdominal muscles when the device is used by two people. When one user pulls back on the exercise element 18, the backrest 88 of the other user will pivot upward from an inclined position. The other user can resist the rotation of the backrest by pressing against it, simultaneously creating more resistance to movement of the exercise element 18. Thus the two users can dynamically change the intensity of the workout. It is also possible for the two users to operate the device only by pressing back against the backrest 88. In this mode of operation, the upper exercise element 46, the handle 52, and their related parts would be removed as a single assembly.

Figure 4:
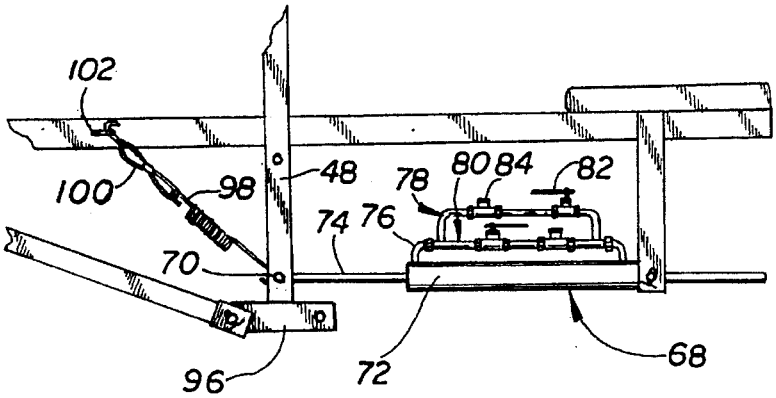
FIG. 4 is a side detail of an alternative embodiment incorporating a spring for use by a single user.

Turning now to FIG. 4, the invention is shown adapted for use by a single person. The invention is shown with one of the longitudinal supports 26 removed for clarity. In the adaptation, the invention is provided with a spring 98, connected to the lower exercise element 48 and through an extension loop 100 to a support element 102 located between longitudinal supports 24 and 26 as shown. The solitary user sits on the same side of the exercise element 18 on which the spring 98 is located and pulls the handle element 52, thus placing the spring in tension. When the user ceases pulling on the element 52, the spring 98 biases the lower exercise element 48 to return to its original position. When only one user is operating the device, the adjustable valve 82 that adjusts resistance to motion in the return direction should be opened fully so that the exercise element 18 will return to the original position quickly. Biasing elements performing the equivalent function of the spring 98 are also envisioned within the spirit of the present invention, such as pneumatic cylinders. The spring 98 and extension loop 100 may be also used during two person operation if desired.

The invention has been shown in only one embodiment. It should be apparent to those skilled in the art that the invention is not so limited, but is susceptible to various changes and modifications without departing from the spirit of the invention.

What is claimed is:

1. An abdominal exercise device, comprising:

a frame having a stationary longitudinal support;

a pair of stationary seating assemblies attached to opposite ends of the frame and oppositely disposed on the frame;

an exercise element between the seating assemblies, coupled to the longitudinal support by a pivot so as to allow the exercise element to reciprocate between a first position and a second position, the exercise element having a pair of handles; and a resistance element connected between the frame and the exercise element, the resistance element providing a controlled resistance to movement of the exercise element between the first position and the second position.

2. An abdominal exercise device as described in claim 1, wherein the pair of handles further comprises:

a handle element pivotably coupled to the upper end of the exercise element; and a pair of operator handles connected transversely to the handle element, the ends of the operator handles terminating in hand grips.

3. An abdominal exercise device as described in claim 1, wherein the resistance element is a dashpot.

4. An abdominal exercise device as described in claim 3, further comprising bypass means for bypassing the resistance element, thereby providing adjustment of the degree of resistance of the resistance element to the movement of the exercise element between the first and second positions.

5. An abdominal exercise device as described in claim 1, further comprising:

a support subframe raised above and rigidly coupled to the frame;

foot rests adapted to removeably interfit with a plurality of holes defined in the support subframe, thereby allowing for adjustment of the foot rests to a desired location.

6. An abdominal exercise device as described in claim 1, further comprising a second longitudinal support parallel to the first longitudinal support, the two longitudinal support members defining a slot through which the exercise element passes.

7. An abdominal exercise device, comprising:

a frame having a longitudinal support;

a pair of seating assemblies attached to opposite ends of the frame and oppositely disposed on the frame;

an exercise element between the seating assemblies, coupled to the longitudinal support by a pivot so as to allow the exercise element to reciprocate between a first position and a second position, the exercise element having a pair of handles; and a dashpot connected between the frame and the exercise element and providing a controlled resistance to movement of the exercise element between the first position and the second position;

two sets of valves for bypassing the dashpot, thereby providing adjustment of the degree of resistance of the dashpot to movement of the exercise element, each set comprising an adjustable valve and a check valve, the sets being connected to allow for separate adjustment of resistance to movement of the exercise element in either direction between the first and second positions.

8. An abdominal exercise device comprising:

a frame having a longitudinal support;

a pair of seating assemblies attached to opposite ends of the frame and oppositely disposed on the frame;

an exercise element between the seating assemblies, coupled to the longitudinal support by a pivot so as to allow the exercise element to reciprocate between a first position and a second position, the exercise element having a pair of handles;

a resistance element connected between the frame and the exercise element, the resistance element providing a controlled resistance to movement of the exercise element between the first position and the second position; and a biasing element oppositely disposed about the exercise element from the resistance element and coupled to the exercise element so as to modulate the resistance provided by the resistance element.

9. An abdominal exercise device as described in claim 8, wherein the biasing element is a spring.

10. An abdominal exercise device comprising:

a frame having a longitudinal support;

a pair of seating assemblies attached to opposite ends of the frame and oppositely disposed on the frame, each seating assembly further comprising a bottom piece, a backrest pivotably coupled to the bottom piece, and a linkage arm pivotably coupled to the backrest and the exercise element, the linkage arm causing the backrest to pivot in the same direction as the exercise element;

an exercise element between the seating assemblies, coupled to the longitudinal support by a pivot so as to allow the exercise element to reciprocate between a first position and a second position, the exercise element having a pair of handles; and a resistance element connected between the frame and the exercise element, the resistance element providing a controlled resistance to movement of the exercise element between the first position and the second position.

11. An abdominal exercise device, comprising:

a frame having a pair of stationary longitudinal supports, the longitudinal supports defining a slot between them;

a pair of stationary seating assemblies attached to opposite ends of the frame and oppositely disposed on the frame;

an exercise element between the seating assemblies, passing through the slot defined by the longitudinal supports and coupled to the longitudinal supports by a pivot so as to allow the exercise element to reciprocate between a first position and a second position, the exercise element having a pair of handles; and a resistance element connected between the frame and the exercise element, the resistance element providing a controlled resistance to movement of the exercise element between the first position and the second position.

12. An abdominal exercise device as described in claim 11, wherein the pair of handles further comprises:

a handle element pivotably coupled to the upper end of the exercise element; and a pair of operator handles connected transversely to the handle element, the ends of the operator handles terminating in hand grips.

13. An abdominal exercise device as described in claim 11, wherein the resistance element is a dashpot.

14. An abdominal exercise device as described in claim 13, further comprising bypass means for bypassing the resistance element, thereby providing adjustment of the degree of resistance of the resistance element to the movement of the exercise element between the first and second positions.

15. An abdominal exercise device as described in claim 14, wherein the bypass means is an adjustable valve.

16. An abdominal exercise device as described in claim 11, further comprising:

a support subframe raised above and rigidly coupled to the frame;

foot rest adapted to removeably interfit with a plurality of holes defined in the support subframe, thereby allowing for adjustment of the foot rest to a desired location.

17. An abdominal exercise device comprising:

a frame having a pair of longitudinal support, the longitudinal supports defining a slot between them;

a pair of seating assemblies attached to opposite ends of the frame and oppositely disposed on the frame;

an exercise element between the seating assemblies, passing through the slot defined by the longitudinal supports and coupled to the longitudinal supports by a pivot so as to allow the exercise element to reciprocate between a first position and a second position, the exercise element having a pair of handles;

a resistance element connected between the frame and the exercise element, the resistance element providing a controlled resistance to movement of the exercise element between the first position and the second position; and a biasing element oppositely disposed about the exercise element from the resistance element and coupled to the exercise element so as to modulate the resistance provided by the resistance element.

18. The exercise device of claim 17, wherein the biasing element is a spring.

* * * * *